US005992184A

United States Patent [19]

Shibuta

[11] Patent Number: 5,992,184

[45] Date of Patent: Nov. 30, 1999

[54] FLAT KNITTING MACHINE HAVING A TRANSFER JACK TRANSFERRING MECHANISM

[75] Inventor: Takekazu Shibuta, Wakayama, Japan

[73] Assignee: Shima Seiki Mfg., Ltd., Wakayama, Japan

[21] Appl. No.: 09/215,009

[22] Filed: Dec. 17, 1998

[30] Foreign Application Priority Data

Dec. 19, 1997 [JP] Japan ..... 9-350875

[51] Int. Cl.[6] ..... D04B 7/00

[52] U.S. Cl. ..... 66/64; 66/148

[58] Field of Search ..... 66/148, 60 R, 66/62, 64, 66, 69, 72

[56] References Cited

U.S. PATENT DOCUMENTS

| | | | |
|---|---|---|---|
| 4,905,483 | 3/1990 | Shima | 66/69 |
| 5,398,527 | 3/1995 | Hirai et al. | 66/148 |
| 5,423,204 | 6/1995 | Shima et al. . | |
| 6,459,717 | 11/1995 | Shibuta et al. | 66/64 |

FOREIGN PATENT DOCUMENTS

| | | | |
|---|---|---|---|
| 41-7907 | 4/1941 | Japan . | |
| 56-21854 | 5/1981 | Japan . | |
| 63-256752 | 10/1988 | Japan . | |
| 1-168943 | 7/1989 | Japan . | |
| 405086562 | 4/1993 | Japan | 66/64 |

*Primary Examiner*—John J. Calvert
*Assistant Examiner*—Larry D. Worrell, Jr.
*Attorney, Agent, or Firm*—McAulay Nissen Goldberg Kiel & Hand, LLP

[57] ABSTRACT

A flat knitting machine having a transferring mechanism using transfer jacks wherein the transfer jacks each have (i) at a front end thereof a loop engaging portion; (ii) at a rear end thereof a selected engaging projection extending rearwardly from a rear end of the jack groove when the transfer jack is in its retracted position; and (iii) at an upper edge of a jack body thereof an advance-and-retreat controlling butt which extends from an upper surface of the jack groove and is engageable with the transfer jack operating cam to control the transfer jack to move forward and backward; and wherein the carriages each include (i) a cam which driven by an actuator so that it can be selectively engaged with the selected engaging projection of the transfer jack to guide the transfer jack in its retracted position from the engaged position to its pushed-out position and which is arranged in association with the selected engaging projection of the transfer jack; (ii) a raising cam which is engageable with the butt projecting from the upper surface of the transfer jack as guided to the pushed-out position, to push up the transfer jack to its transferring position; and (iii) a lowering cam which can act on the butt of the transfer jack as advanced to its transferring position, to drive the transfer jack to retract to its retracted position.

5 Claims, 12 Drawing Sheets

FLAT KNITTING MACHINE HAVING A TRANSFER JACK TRANSFERRING MECHANISM

BACKGROUND OF THE INVENTION

1. Field of the Invention

The present invention relates to an improvement of a transfer jack transferring mechanism of the so-called three or four beds type flat knitting machine comprising (i) needle beds which contain knitting needles received in movable relation in needle grooves and are arranged in front and rear confronting each other and (ii) transfer beds which are located over the needle beds and contain transfer jacks received in movable relation in jack grooves, to receive loops from knitting needles of the needle beds and then transfer the received loops to the other knitting needles arranged in the lateral side.

2. Description of the Prior Art

Many proposals have been made hitherto on this kind of flat knitting machine by, for example, Japanese Patent Publications No. Sho 41(1966)-7907 and No. 56(1981)-21854 and Japanese Laid-open Patent Publications No. Hei 1(1989)-168943 and No. Sho 63(1988)-256752. However, the prior art had no mechanism to enable a carriage or transferring cain to be moved adversely at any position on the needle bed when a loop is transferred between the knitting needle and the transfer jack, for the reason of which the carriage was forced to move in reciprocation along the entire width of the needle bed. As a result of this, the prior art had a problem that the number of the knitting courses per unit time was reduced and thus productivity was reduced significantly. Especially, this problem comes to be more pronounced as the knit width forms a decreasing proportion of the entire length of the needle bed.

To solve this problem, the applicant previously proposed a flat knitting machine disclosed by U.S. Pat. No. 5,398,527 (which corresponds to Japanese Laid-open Patent Publication No. Hei 6(1994)-136641). This flat knitting machine is provided with a transfer jack selecting means and is structured so that the carriage and the transferring cam can be moved adversely at any position on the needle bed, to increase the number of the knitting courses per unit time and thus increase productivity remarkably, while also, the transferring mechanism including the transfer jack selecting means can be arranged in a dead space of the flat knitting machine without an excessive increase of the size of the transferring mechanism.

This flat knitting machine is, however, structured such that the transfer jacks are received in swingable relation in jack grooves arranged in rows in the transfer jack beds so that their selected butts extending from upper surfaces of the transfer jacks can project or retract from upper surfaces of the jack grooves. Before a selecting portion provided in the carriage pass the transfer jacks, all selected butts of the transfer jack are pushed back to the positions projecting from the jack grooves by return cams, for the present. Then, the groups of the transfer jack selected butts not required for the knitting are pushed down into the jack grooves by means of convex cam portions operated to swing by means of actuators at the selecting portion, so that only the groups of transfer jack selected butts still projecting from the upper surface of the jack grooves without being acted upon by the convex cam portions can be engaged with the operating cam to shift the transfer jacks to the transferring positions.

Thus, the flat knitting machine previously proposed by the applicant requires the mechanism for forcing the transfer jacks to be swung in the jack grooves. In addition, every time the carriage passes the transfer jacks, all the transfer jacks are forced to be engaged with the cam portions, whether they are required for the knitting or not. As a result of this, there is a fear of the engaging portions of the transfer jacks being worn by abrasion and the like.

SUMMARY OF THE INVENTION

In accordance with the above, it is an object of the invention to provide a flat knitting machine having a transfer jack transferring mechanism which has a simplified structure eliminating the need of a swinging mechanism for forcing the transfer jacks to be vertically swung to be shifted in position in jack grooves at the time of selecting the transfer jacks and has capability of bringing the transfer jacks into cam engagement by operating cam, only when the transfer jacks are used, to prevent wear of engaging portions of the transfer jacks.

The present invention is directed to a flat knitting machine having a transferring mechanism using transfer jacks, the flat knitting machine comprising:

a pair of front and rear needle beds facing each other to form an inverted V-shaped form with a needle bed gap defined between adjoining end portions of the needle beds;

knitting needles received in needle grooves formed in rows on the needle beds;

front and rear carriages reciprocally movable on the needle beds and having a knitting needle operating cam for controlling the knitting needles to move forward and backward;

a transfer jack bed supported by a supporting member and arranged over at least any one of the needle beds;

transfer jacks received in reciprocally movable relation in jack grooves formed in rows on the transfer jack bed;

a transfer jack operating cam provided at a front end portion of the carriage in proximity to the needle bed gap between the needle beds; and a transferring mechanism for enabling the transfer jack bed and the needle beds to move relative to each other in a lateral direction, to transfer a loop between the transfer jack and the knitting needle, wherein the transfer jacks each have (i) at a front end thereof a loop engaging portion; (ii) at a rear end thereof a selected engaging projection extending rearwardly from a rear end of the jack groove when the transfer jack is in its retracted position; and (iii) at an upper edge of a jack body thereof an advance-and-retreat controlling butt which extends from an upper surface of the jack groove and is engageable with the transfer jack operating cam to control the transfer jack to move forward and backward; and wherein the carriages each include (i) a cam which is driven by an actuator so that it can be selectively engaged with the selected engaging projection of the transfer jack to guide the transfer jack in its retracted position from the engaged position to its pushed-out position and which is arranged in association with the selected engaging projection of the transfer jack; (ii) a raising cam which is engageable with the butt projecting from the upper surface of the transfer jack as guided to the pushed-out position, to push up the transfer jack to its transferring position; and (iii) a lowering cam which can act on the butt of the transfer jack as advanced to its transferring position, to drive the transfer jack to retract to its retracted position.

The transfer jacks are composed of at least two kinds of transfer jacks, with the selected engaging projections shifted in phase from each other with respect to the heightwise direction, and a selecting portion is provided at a position corresponding to the transfer jack engaging projection.

The transfer jacks are bunched together in groups of two or more under the same height of selected engaging projections, and those transfer jacks groups different in height of the selected engaging projections are arranged alternately.

The cam for guiding the transfer jack to its pushed-out position is formed by a swinging cam which is swingable between two positions of (i) an operative position at which the selective engaging projection is pushed out by a swinging lever and a swinging actuator capable to switch the swinging lever and (ii) a standby position at which the selected engaging projection is not acted upon by the swinging lever and the swinging actuator.

The swinging cam has a cam surface having a substantial widthwise dimension smaller than the widthwise dimension of each of the transfer jack groups.

The transfer jacks are usually in their retracted position at which the selected engaging projections are exposed from the rear end of the jack grooves. Before the loops are transferred between the transfer jacks and the knitting needles, the swinging cam, which is driven to swing by the swinging actuator arranged in the carriage, acts on a group of transfer jacks including the transfer jacks which act to transfer the loops and is shifted to an operative position at which the swinging cam is engaged with the engaging projections of the transfer jacks. As the carriage passes the transfer jacks in this state, the swinging cam is brought into engagement with the engaging projections and the transfer jacks are advanced in the jack grooves up to their pushed-out position. On the other hand, the swinging cam of the actuator which is in the non-operative position at which the swinging cam is not engaged with the engaging projection does not act on a group of transfer jacks including no transfer jacks which act to transfer the loops, and thus no action is given to these transfer jacks. The transfer jacks brought to the pushed-out position by the swinging cam are advanced further to the transferring position by subsequent movement of the carriage by which the advance-and-retreat controlling butts on the upper surfaces of the transfer jacks are brought into engagement with the transfer jack operating cam.

BRIEF DESCRIPTION OF THE DRAWINGS

FIG. 8 is a showing of actuators for the transfer jacks.

DETAILED DESCRIPTION OF THE EMBODIMENT

Referring now to the accompanying drawings, an example of the preferred embodiment of the present invention directed to a flat knitting machine having a transfer jack transferring mechanism will be described below. It is to be understood, however, that the scope of the invention is by no means limited to the illustrated embodiments.

Figure 1:
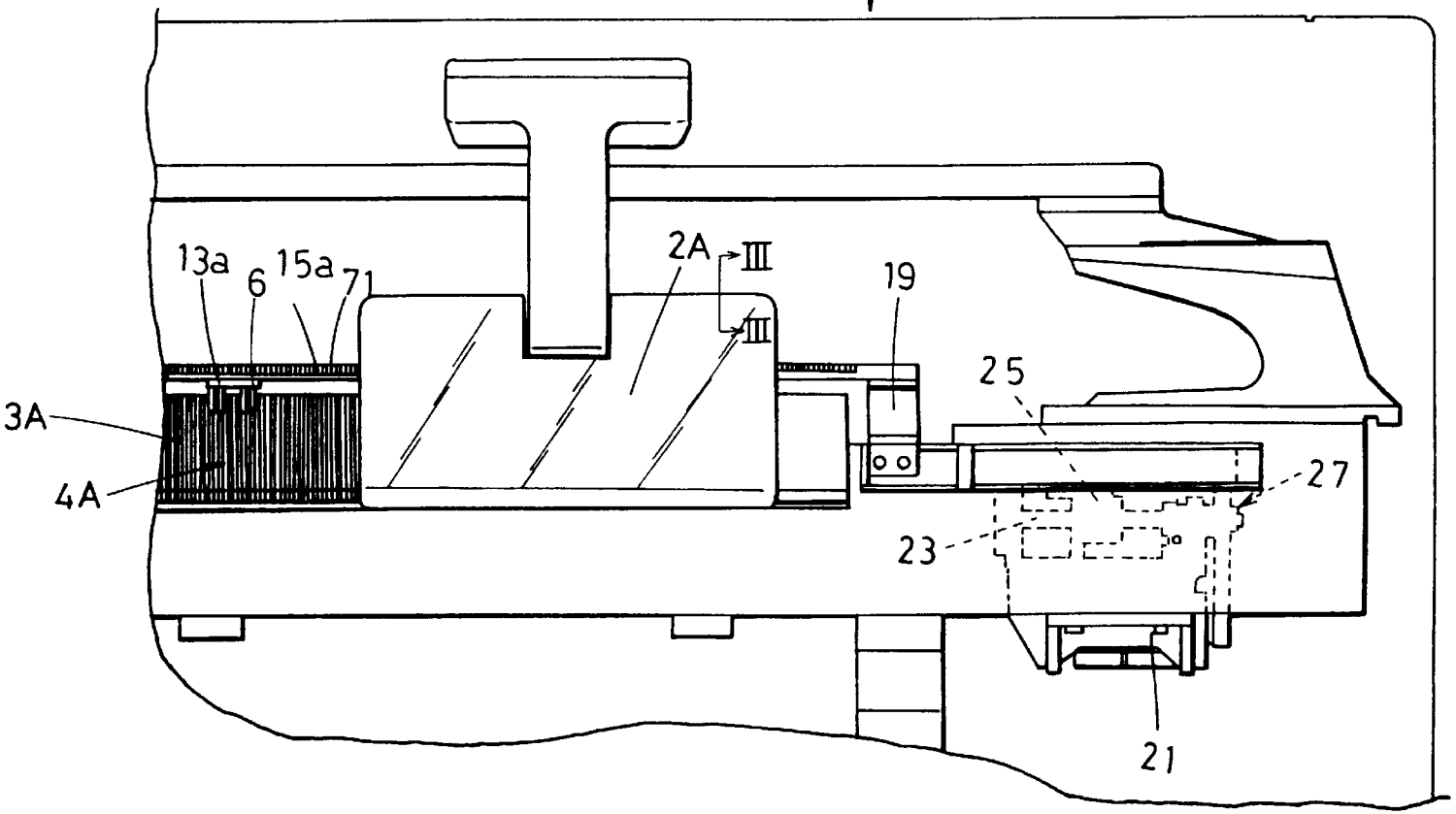
FIG. 1 is a schematic partly cutaway front view of a flat knitting machine having a transferring mechanism using transfer jacks of an embodiment of the present invention.
Figure 2:
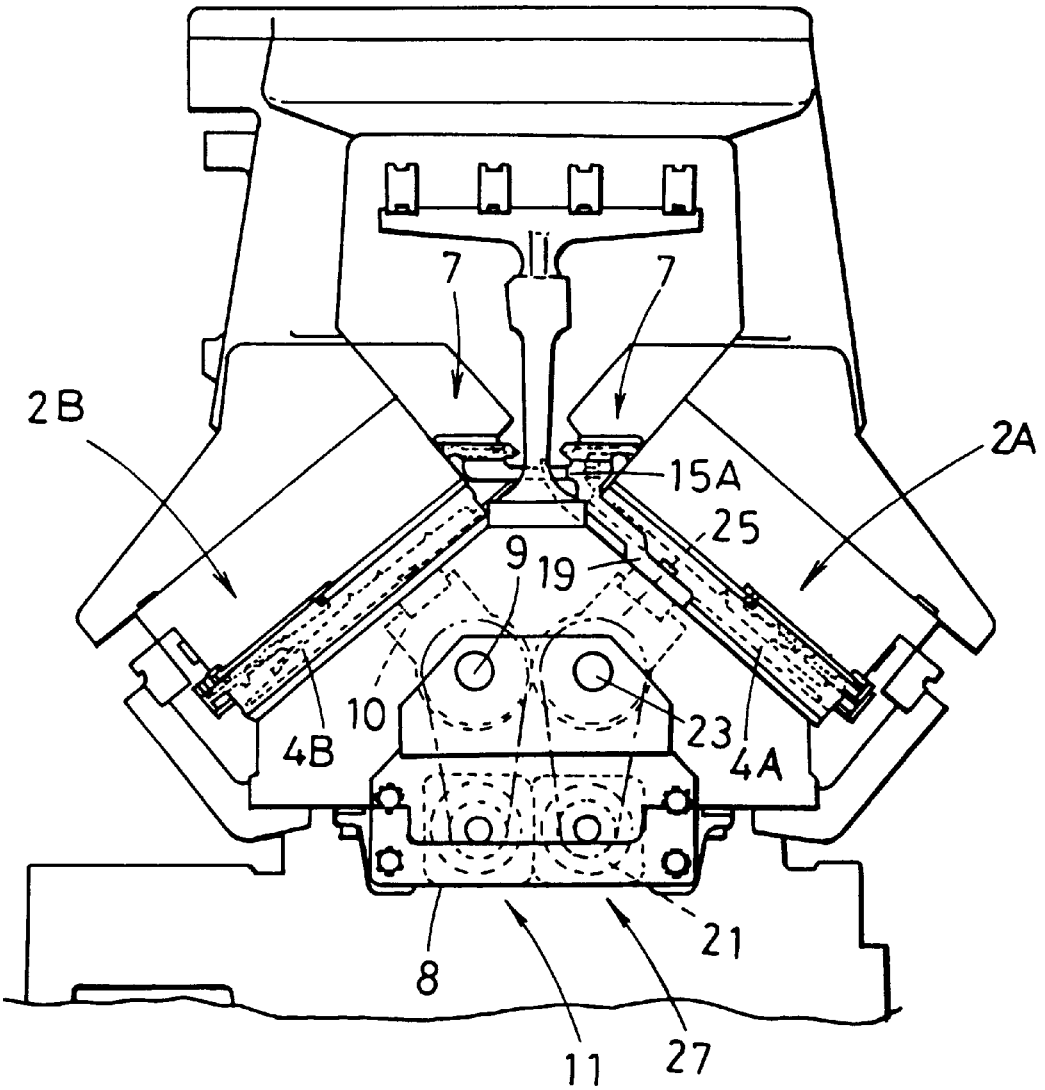
FIG. 2 is a schematic side view of the same.
Figure 3:
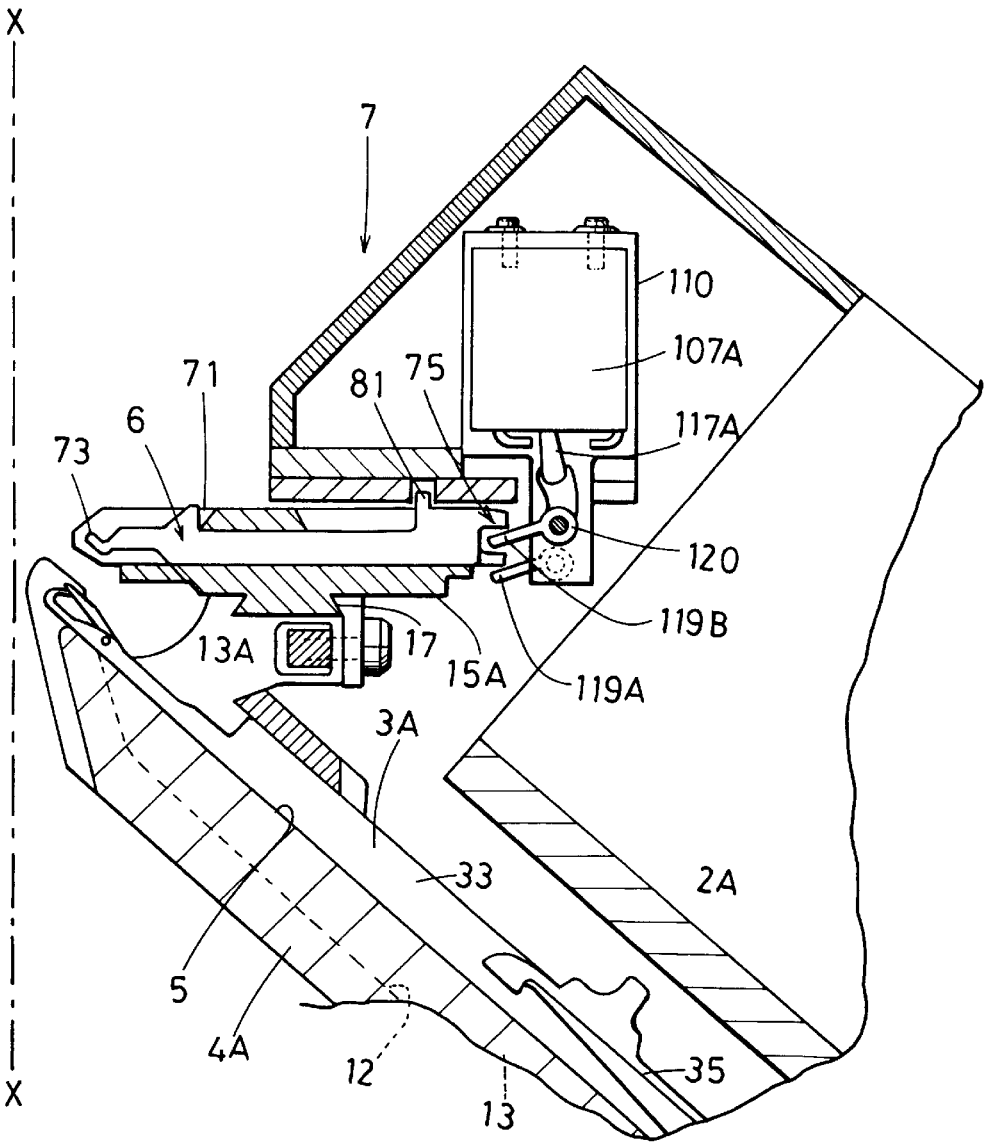
FIG. 3 is a vertically sectioned side view of a principal part of the same taken along the line III—III in FIG. 1.

FIG. 1 is a schematic front view of a flat knitting machine having a transferring mechanism; FIG. 2 is a side view of the same; and FIG. 3 is a vertically sectioned side view of an enlarged principal part of the same taken along the line III—III in FIG. 1, showing a part on a front needle bed side only. The part on a rear needle bed side is the mirror image of that of the front needle bed side with reference to a line X.

Referring to FIG. 1 through FIG. 3, a flat knitting machine 1 of the embodiment comprises flat front and rear needle beds 4A, 4B which contain a number of knitting needles 3A, 3B driven to move reciprocally in needle grooves 5 by carriages 2A, 2B and which are arranged in an inverted V-shaped form with their front ends facing close to each other; and transferring mechanisms 7 having transfer jacks 6 and arranged over the front and rear needle beds, respectively. The rear needle bed 4B is so structured as to be racked by driving means 11 including a motor 8, a driving screw shaft 9 and a slider 10.

It is noted that the words of "front" and "rear" used to members, positions, locations, arrangements and the like in the description imply the near side to the needle bed gap and the far side away from the needle bed gap, respectively.

The transfer jack transferring mechanisms 7, formed between carriages 2A and 2B, each have needle plates 13 as needle groove forming members which are inserted in a number of needle grooves 12 formed in the needle bed 4A and are extended upwardly, as shown in FIG. 3. Upper portions 13A of the needle plates are formed as supporting surfaces of transfer jack beds 15A, 15B which are supported in front and rear via a sliding mechanism 17 in sliding engagement within a groove. The front and rear transfer jack beds 15A and 15B are connected with each other at one end portions thereof via a move control bracket 19 which is driven to be racked by driving means 27 including a motor 21, a driving screw shaft 23 and a slider 25 (see FIG. 2).

Figure 4:
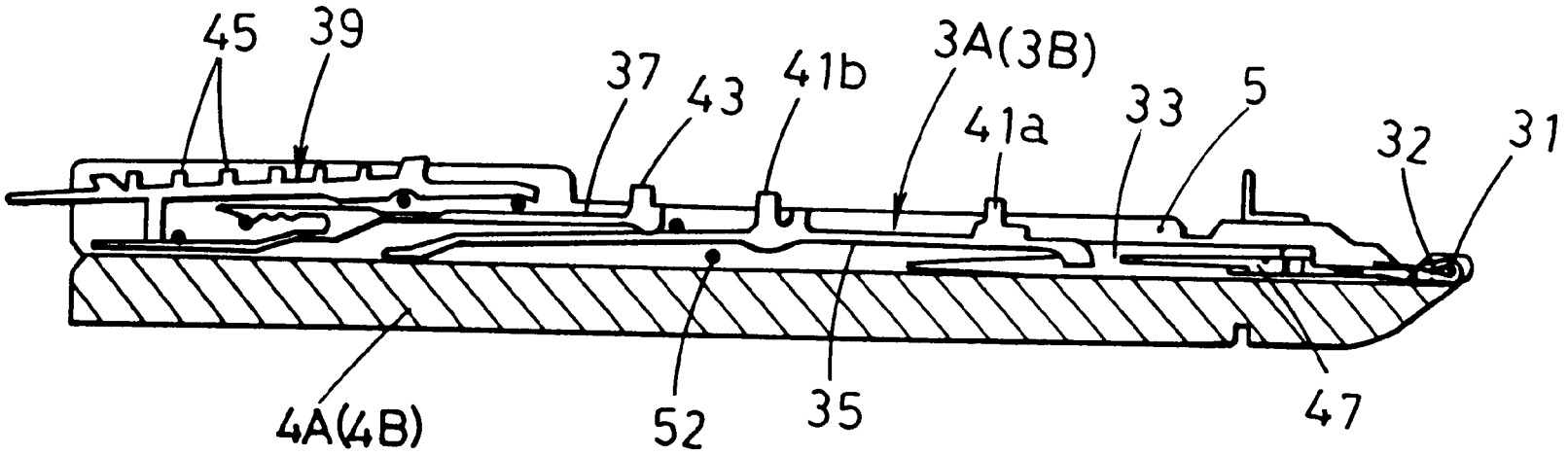
FIG. 4 is a showing of knitting members contained in a needle bed of the flat knitting machine.

The knitting needles 3A, 3B, which are contained in the needle grooves 5 of the needle beds 4A, 4B, respectively, each comprise a knitting needle body 33 having a hook 31 at a front end thereof, a jack 35 connected to a rear end portion of the knitting needle body 33, a selecting jack 37 laid over a rear portion of the jack 35 and a selector 39, which are arranged in the order presented above, as shown in FIG. 4. The jack 35, the selecting jack 37 and the selector 39 have butts 41*a* and 41*b*; 43; and 45 projected from the upper surfaces thereof, respectively, and are driven to move forward and backward in the needle groove 5 by control cams (as will be mentioned later) mounted on the carriages 2A, 2B associated with those butts. The knitting needle body 33 is provided, at one side thereof, with a transferring loop expanding member 47, what is called "a wing", for expanding a loop retained by the knitting needle 3A, 3B. The expanding member 47 is formed by bending sheet metal into a boat like shape, in plan view, and is fixed to the one side of the knitting needle body 33 at one end thereof.

Figure 5:
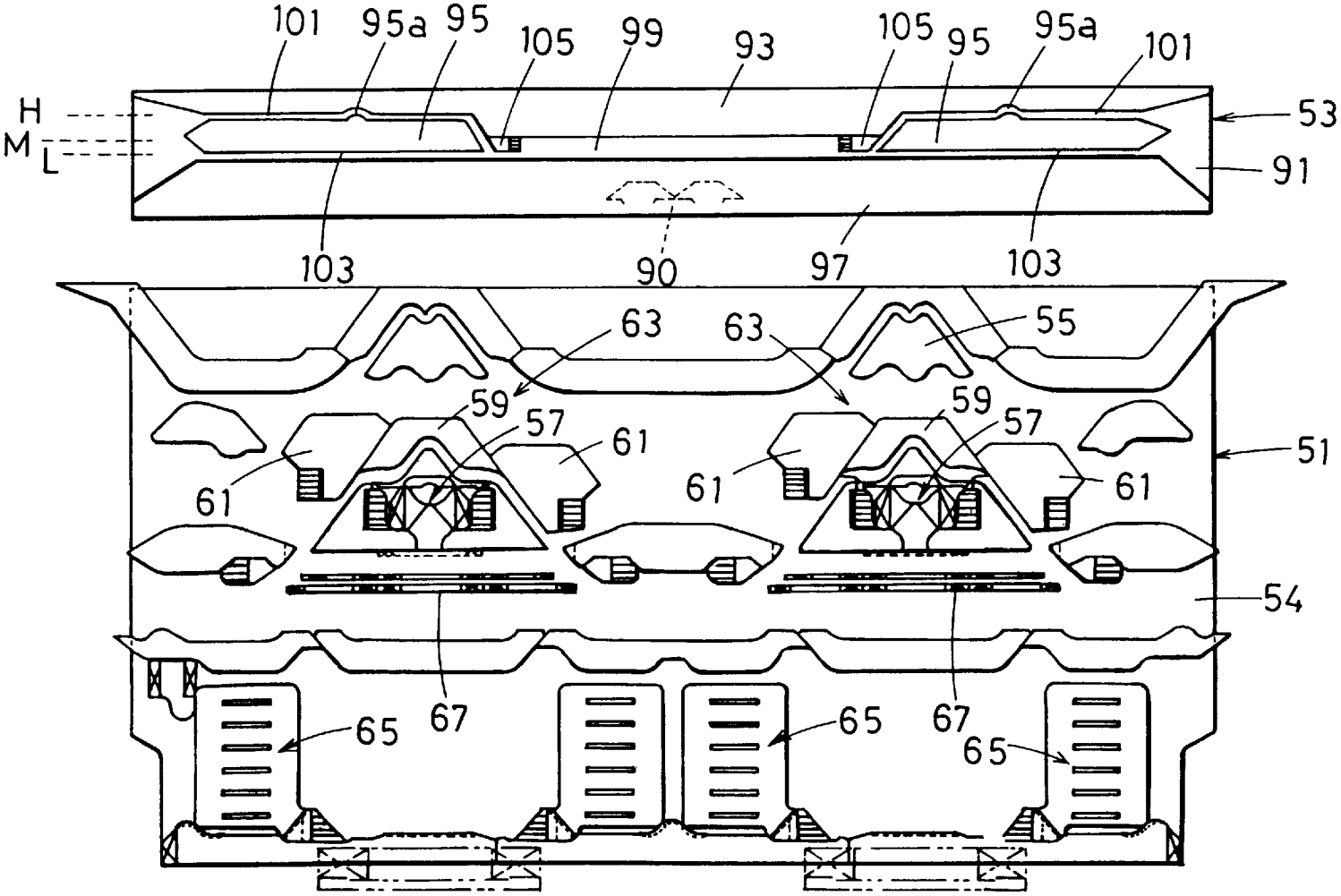
FIG. 5 is a perspective diagram illustrating a cam layout of a knitting needle operating cam and a transfer jack operating cam mounted on a carriage according to the embodiment of the present invention.

FIG. 5 is a perspective diagram illustrating a cam layout of a knitting needle operating cam 51 and a transfer jack operating cam 53 mounted on the carriage 2. In a cam plate 54 of the knitting needle operating cam 51, two cam units 63, 63 are arranged side by side. Each of the cum units 63 comprises a transferring raising cam 55 operated to project and retract by a solenoid or a motor (not shown); a substantially trapezoid, retractable, transferring receiving cam 57 arranged under the transferring raising cam 55; a cam top 59 formed over the transferring receiving cam 57; and convex portions 61, 61 arranged at the sides of the cam top 59. At the rear side of the each cam unit 63, a needle selecting actuator 65 which acts on the butts 45 of the selector 39 of the knitting needle 3 is arranged. Between the needle selecting actuators 65 and the cam unit 63, a pressor portion 67 which acts to press against the butt 43 of the selecting jack 37 so as to locate the knitting needles 3 at the position for knitting, tucking, missing or transferring.

Now, the transferring mechanism 7 having the transfer jack 6 will be described with reference to FIG. 3 and FIGS. 5 to 8.

Figure 7:
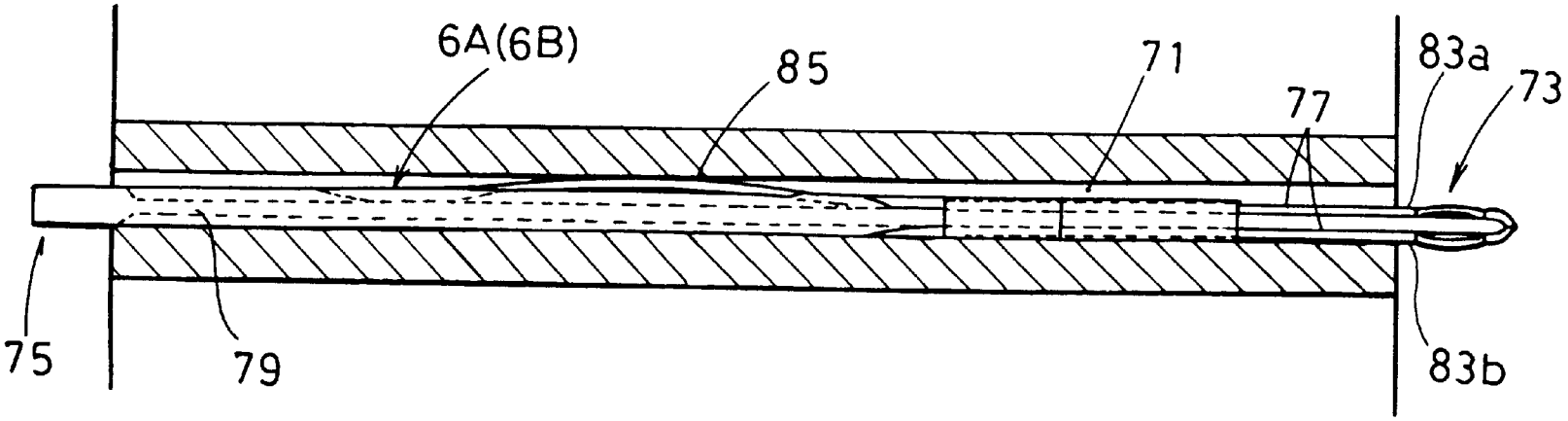
FIG. 7 is a bottom view of a transfer jack.

In the upper surface of the transfer jack bed 15A supported over the needle bed 4, a number of jack grooves 71 are formed in which the transfer jacks 6 are received in a slidable manner. The transfer jack operating cam 53 including the selecting portion of the transfer jack 6 is arranged on the transfer jack bed at the position confronting the carriage running over the needle bed. The transfer jack 6 has a hook shaped loop engaging portion 73 at the front end thereof and a selected engaging projection 75 at the rear end thereof (see FIG. 7). Reference numeral 77 designates a gouged portion formed in the loop engaging portion 73 toward a jack body 79. Reference numeral 81 designates an advance-and-retreat controlling butt extending upwardly from the jack body (see FIG. 3). From the opposite side portions of the jack body 79, spring steel strips 83*a*, 83*b*) are extended and are so curved as to abut with each other at the tip ends thereof The tip end portions of the spring steel strips are formed into a hook shape, as viewed from the side, to form the loop engaging portion 73. The spring steel strip 83*b* at one side of the jack body is curved at a portion toward the basal end, to form a spring portion 85. The spring portion 85 acts to prevent an awkward behavior of the transfer jack 6 in the jack groove 71. FIG. 7 is a bottom view of the transfer jack.

Figure 6A:
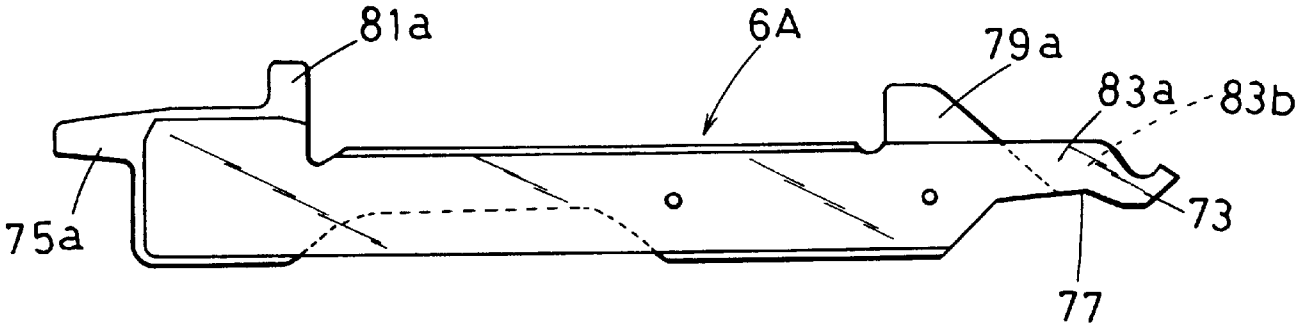
FIG. 6 is a side view of two different kinds of transfer jacks according to the embodiment.
Figure 6B:
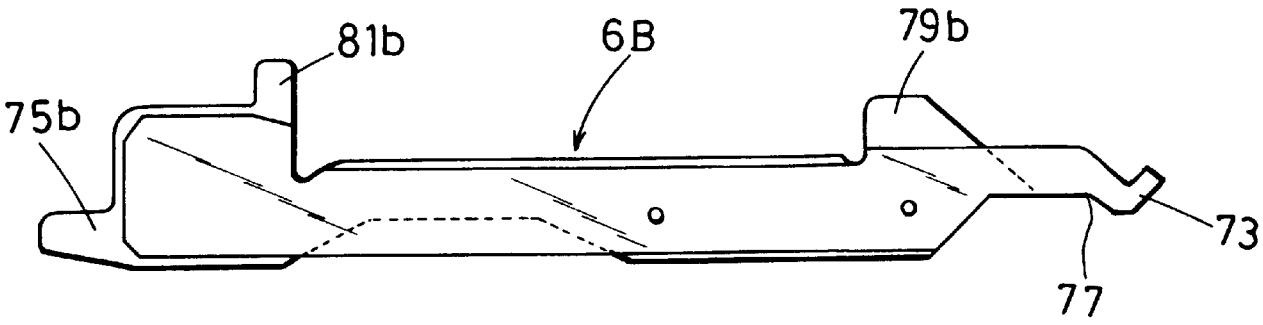

The transfer jacks 6 contained in the jack grooves 71 include two different kinds of transfer jacks 6A, 6B, as shown in FIG. 6*a* and FIG. 6*b*, which are only different in structure in that the selected engaging projections 75*a*, 75*b* extending rearwardly from the rear end portion of the jack body 79 are shifted in phase from each other with respect to the heightwise direction. When the transfer jacks 6 are in the retracted position at which the transfer jacks are not acted to advance and retreat by the transfer jack operating cam 53, as will be discussed later, the selected engaging projections 75 of the transfer jacks 6 are exposed from the jack grooves 71 (see FIG. 3). The two different kinds of transfer jacks 6 are bunched together in groups of two or more under the same kind of transfer jacks 6A, 6B, and the two different kinds of transfer jacks thus grouped are arranged alternately every 1 inch, for example, and received in the jack grooves 71 in the transfer jack beds 15. The carriage 2 is provided with selecting portions 90 including two sets of actuators arranged in association with the selected engaging projections 75*a*, 75*b* of the transfer jacks 6A, 6B.

Next, the operating cam 53 and the selecting portion 90 for the transfer jacks 6 will be described.

As shown in FIG. 5, a cam plate 91 is projected from a tip end portion of the carriage 2 to cover an upper surface of the transfer jack bed 15. The cam plate 91 is provided with an upper guide cam 93, a middle guide cam 95 and a lower guide cam 97 which are arranged in the order from the near side of the needle bed gap. At a position around the center of the cam plate 91 overlapping the lower guide cam 97, the selecting portion 90 is provided which is so structured as to selectively act on the selected engaging projections 75 of the transfer jacks 6. A center cam groove 99 formed between the upper guide cam 93 and the lower guide cam 97 is made wider than other cam grooves between the other guide cams, for the purpose of receiving therein the butt 81 of the transfer jack 6 pushed out from the retracted position L to the pushed-out position M when the transfer jacks 6 are acted upon by a swinging cam of an actuator of the selecting portion 90 as will be discussed later. Cam grooves 101 formed between the upper guide cam 93 and the middle guide cam 95 are for allowing this transfer jack 6 guided to the pushed-out position M by the swinging cam to be pushed up to and retracted from the transferring position H. Cam grooves 103 formed between the middle guide cam 95 and the lower guide cam 97 are for allowing the transfer jacks 6 not selected to pass with being held at the retracted position L.

Designated by reference numeral 105 in illustration are cams which act in only one traveling direction of the carriage to allow the transfer jack 6 retracted from the transferring position H to the raised position M to retract to the retracted position L.

Figure 8A:
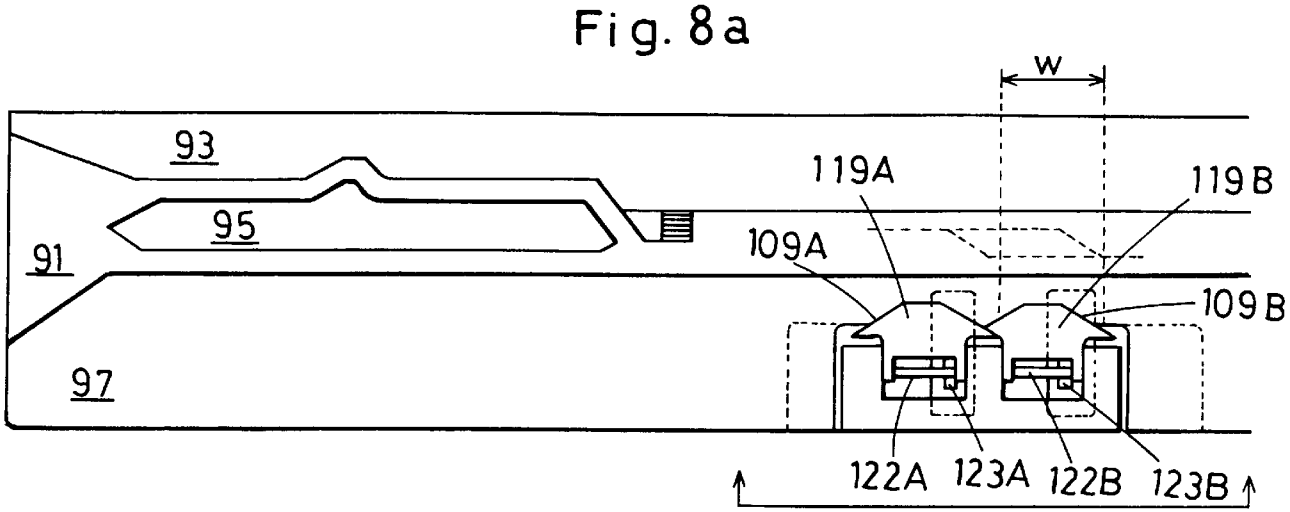
FIG. 8*a* is a view of the transfer jack operating cam including the actuators as viewed from the bottom of a cam plate.
Figure 8B:
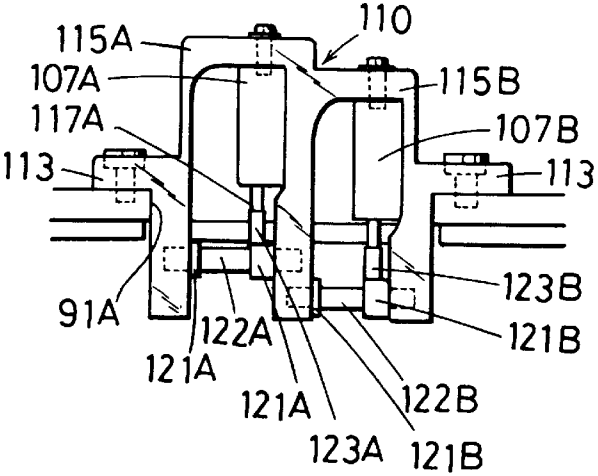
FIG. 8*b* is a view of a selecting portion arranged in a cam plate as viewed from the direction of an arrow of FIG. 8*a;*

FIG. 8 shows the details of the selecting portion 90 mounted on the cam plate 91. FIG. 8*a* is a showing of the same as viewed from the bottom of the cam plate; and FIG. 8*b* is a showing of the same as viewed from an arrow in FIG. 8*a*.

The selecting portion 90 is mainly composed of actuators 107, swinging cams 109; and a holder 110 in which these components are assembled. The holder 110 is fitted in a cutaway portion 91A, formed in the cam plate 91 so that the swinging cams 119 can project from a bottom surface of the cam plate 91 and is screwed to an upper surface of the cam plate 91 at the mounting portions 113 extending outward from both sides of the holder 110. The holder 110 has heightwise stepped mounting portions 115A, 115B for mounting thereto two sets of actuators 107A, 107B for selecting each group of the two different kinds of transfers jacks 6A, 6B having the selected engaging projections 75*a*, 75*b* at different heights. The actuators 107A, 107B are set in the mounting portions 115A, 115B and screwed thereto.

The actuators 107 are formed as a swinging actuator for enabling a swinging lever 117 to switch between two positions. Swinging cams 119, each having a mountain-like shape in a plan view and a L-like shape in side view, are rotatably supported to the holder 110 via pins 122 inserted in pin insertion bores 121 formed in L-like bending portions 120 of the swinging cams. The swinging cams 119 are provided, at the side thereof confronting the swinging actuators 107, with coupling portions 123 having at the tip end thereof circularly cutaway portions for receiving the tip ends of the swinging levers 117. The swinging cams 119 are provided, at the side thereof confronting the selected engaging projections 75 of the transfer jacks 6, with the convex cam portions 109 to act on the engaging projections 75. The swinging levers 117 are driven to swing forward and backward by the action of the swinging actuators 107, with the result that the convex cam portions 109 are driven to swing vertically around the supporting pins 122 serving as swinging shafts. The mountain-shaped convex cam portions 109 to act on the selected engaging projections 75 of the transfer jacks 6 have a substantial widthwise dimension (w) smaller than the widthwise dimension of each of the transfer jack groups of two or more received in the jack grooves 71. The convex cam portions 109 acts directly to the selected engaging projections 75 of the transfer jacks 6 which are in the retracted position, to drive the transfer jacks 6 toward the needle bed gap, and thereby the butts 81 formed on the upper surface of the transfer jacks are guided to an engagement position at which the butts 81 are engaged with the raising cam surface of the middle guide cam 95.

Next, operation of the transferring mechanism 7 having the transfer jacks 6 mentioned above will be described.

When the carriage 2 is driven reciprocally on the needle bed 4, the butts 41*a*, 41*b* and 43 of selected knitting needles 3 are operated by the knitting needle operating cam 51 arranged in the carriage 2, to drive the selected knitting needles 3 reciprocally in the needle grooves 5, so as to knit a knitting fabric of a predetermined width, with a yarn fed from a yarn feeder (not shown). When the knitting needles 3 are merely operated without any transference of loops between the transfer jacks 6 and the knitting needles 3, the swinging actuators 107 of the selecting portion 90 for the transfer jacks 6 are not energized and the swinging cams 119 are held in their non-operation mode of being swung downward. As a result of this, the cam engagement between the engaging projections 75 of the transfer jacks 6 and the operating cams 53 is not caused. Thus, while the carriage 2 is driven reciprocally to knit the knitting fabric, the transfer jacks 6 are maintained with their being held in the retracted position.

Next, an example of how a loop 128 retained by a front knitting needle 3A is transferred transversely to an adjacent knitting needle 3A in the front needle bed 4A through the transfer jacks 6 confronting the front knitting needle 3A will be described with reference to FIGS. 9 to 12.

Figure 9:
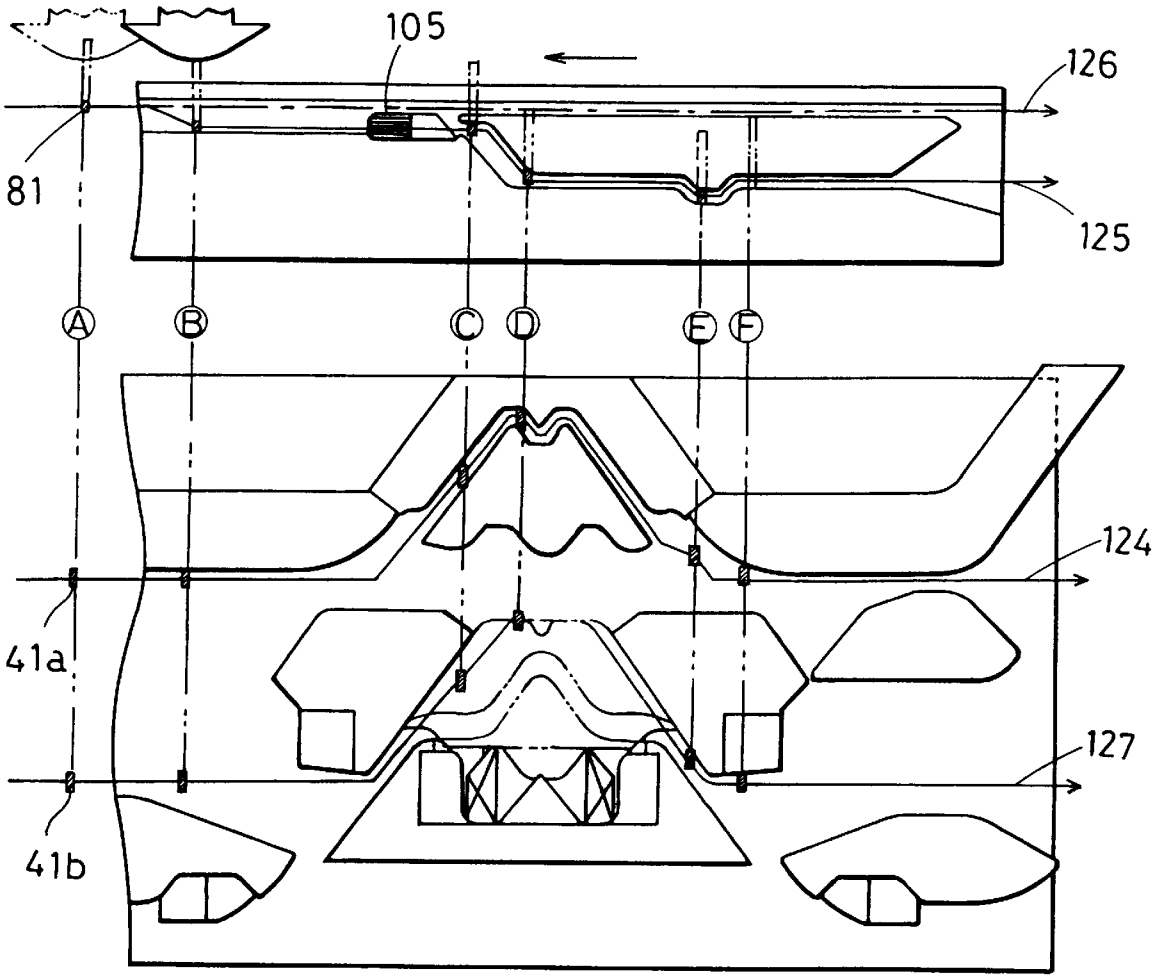
FIG. 9 is a view illustrating traveling paths of butts taken when the carriage moves leftwards to transfer a loop from a knitting needle to the transfer jack.

FIG. 9 shows a part of the operating cam 51 for the carriage 2 which drives the knitting needle 3A of the front needle bed 4A reciprocally and a part of the operating cam 53 which drives the transfer jack 6 in the rear transfer jack bed 15B reciprocally. The figure also shows the traveling paths of the butts 41*a*, 41*b* and 81 taken when the loop 128 retained in the knitting needle 3A is transferred to the transfer jack 6 when the carriage 2 is driven leftwards on the needle bed 4A. Reference numerals 127 and 124 show the traveling paths of the butts 41*a*, 41*b* at the front and rear portions of the jack 35 of the knitting needle 3A. A dashed line 126 in illustration designates a passing course of the butt 81 of the transfer jack 6 which was not selected in the selecting portion 90. Shown in FIG. 10 are side views of the knitting needle 3A and the transfer jack 6 which are in the phases A–F of FIG. 9.

Figure 10:
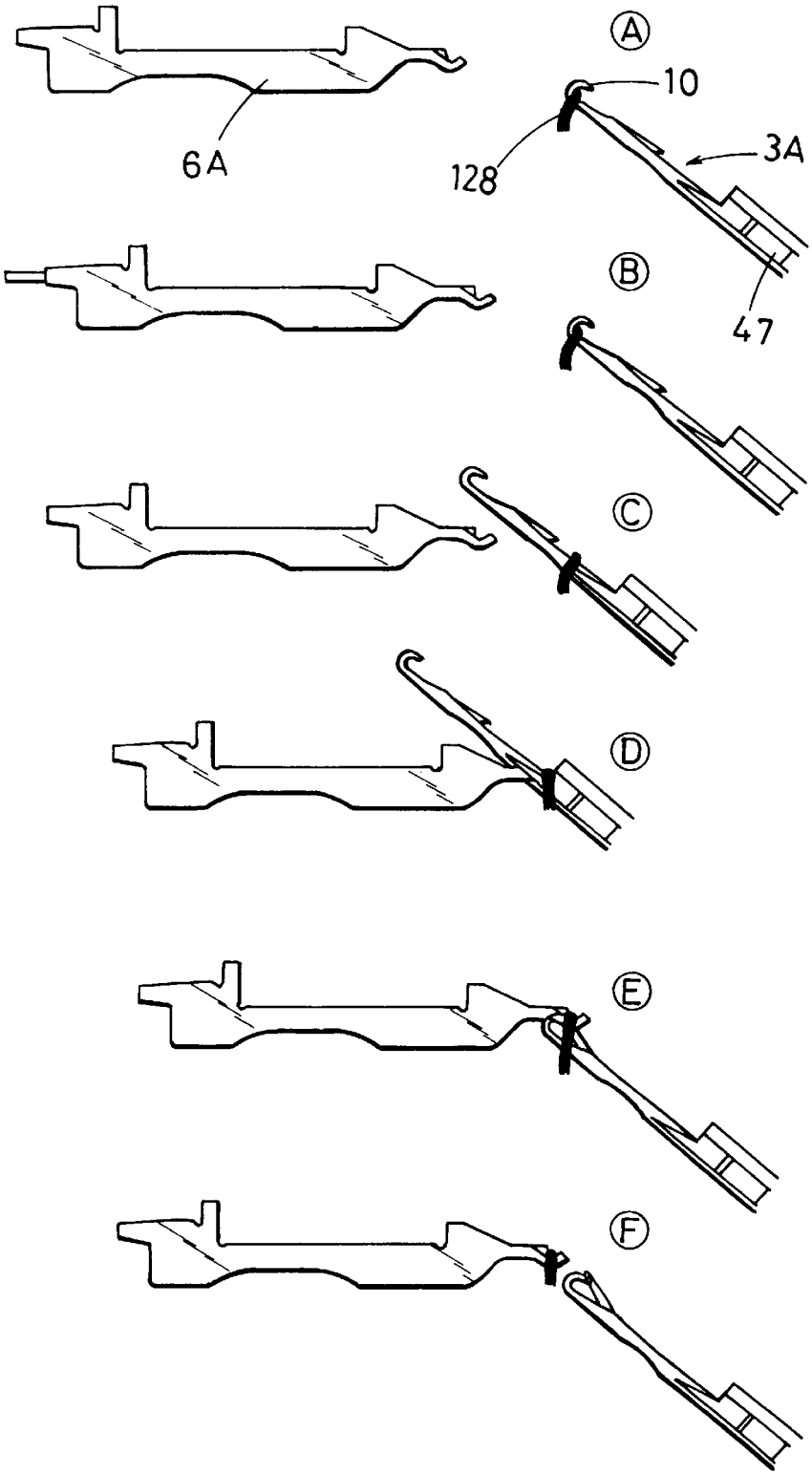
FIG. 10 is a side view of the motional relationship between the knitting needle and the transfer jack in each of the positions A–F of FIG. 9.

At position A, the knitting needle 3A and the transfer jack 6 are both in their retracted positions (FIG. 10-A). Before they reach the position B, the swinging lever 117 is swung rearwards to shift the swinging cam 119 upwardly by energizing the actuator 107A or 107B corresponding to a group of transfer jacks 6 to be selected.

At position B, the selected engaging projection 75 of the transfer jack 6 is engaged with the convex cam portion 109 of the swinging cam 119 as upwardly shifted, to push out the transfer jack 6 along the convex cam portion 109. As a result, the butt 81 is advanced to the position M (FIG. 10-B).

At position C, the butt 41*a* of the jack 35 is gradually pushed up by the transfer raising cam 55 of the carriage 2, and thus the front knitting needle 3A is raised gradually. As a result of this, the loop 128 open a latch 32 and also is expanded by the expanding member 47 (FIG. 10-C). At that time, the butt 81 of the transfer jack 6 passes the cam 105, pressing the cam 105 downwards along the slanted surface.

At position D, the front knitting needle 3A is pushed forward furthest and also the butt 81 of the transfer jack 6 is pushed forward up to the transferring position H by being acted upon by the raising cam surface of the middle cam 95. The loop engaging portion 73 at the tip end of the transfer jack is inserted into the loop 128 expanded by the expanding member 47 of the opposite knitting needle 3A (FIG. 10-D).

At position E, the butt 41*b* of the jack 35 is pushed downward by the convex portion 61 and the knitting needle 3A is lowered. Along with this, the butt 81 of the transfer jack 6 is pushed out a little further by the convex portion 95*a* of the middle guide cam 95 so that the latch 32 closed when the knitting needle 3A is driven backwards can be cleared (FIG. 10-E).

When the knitting needle 3A reaches the position F of the carriage 2, the butt 41*b* of the jack 35 passes the convex portion 61, so that the loop 128 retained by the knitting needle 3A is transferred to the loop engaging portion 73 at the tip end of the transfer jack 6 advanced to the needle bed gap (FIG. 10-F).

The transfer jack 6 is maintained in the advanced position, keeping the loop 128 received by the loop engaging portion 73, even after the carrier 2 passes over the transfer jack 6.

In this state, the motor 21 of the driving means 27 is driven to rotate the driving screw shaft 23 so that the transfer jack bed 15 can be racked by predetermined pitches (e.g. by a pitch corresponding to one knitting needle) via the slider 25 and the move control bracket 19 to be moved relative to the needle bed 4A. At the racking, the gouged portion 77 formed in the loop engaging portion 73 toward the jack body of the transfer jack 6 is positioned above a projection, such as a sinker 129, arranged at the needle bed gap between the needle beds 4A, 4B, and thus the transfer jack 6 is avoided interfering with the sinker 129.

Figure 11:
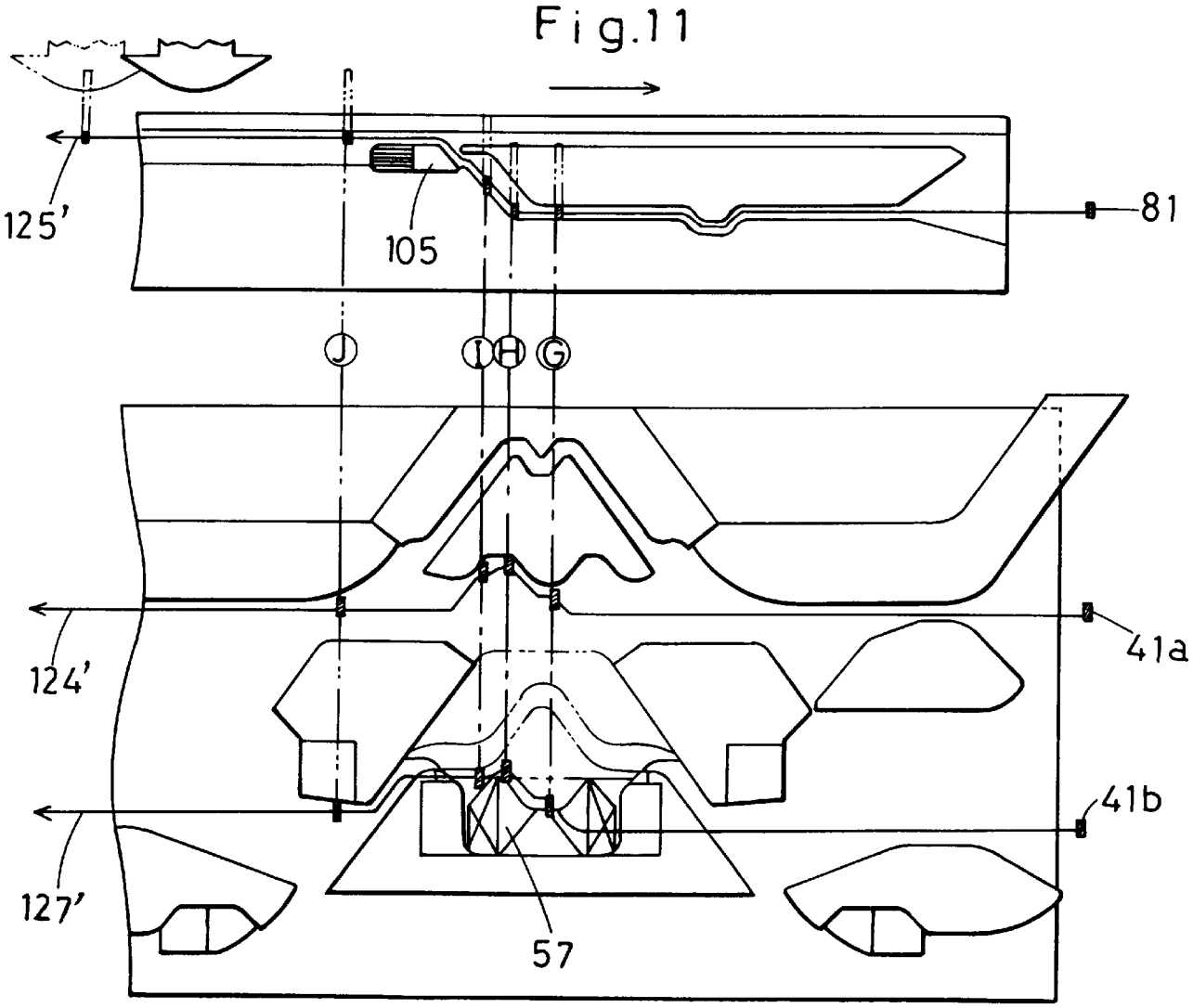
FIG. 11 is a view illustrating traveling paths of the butts of the knitting needle and the transfer jack taken when the carriage moves rightwards to transfer a loop from the transfer jack to the knitting needle.
Figure 12:
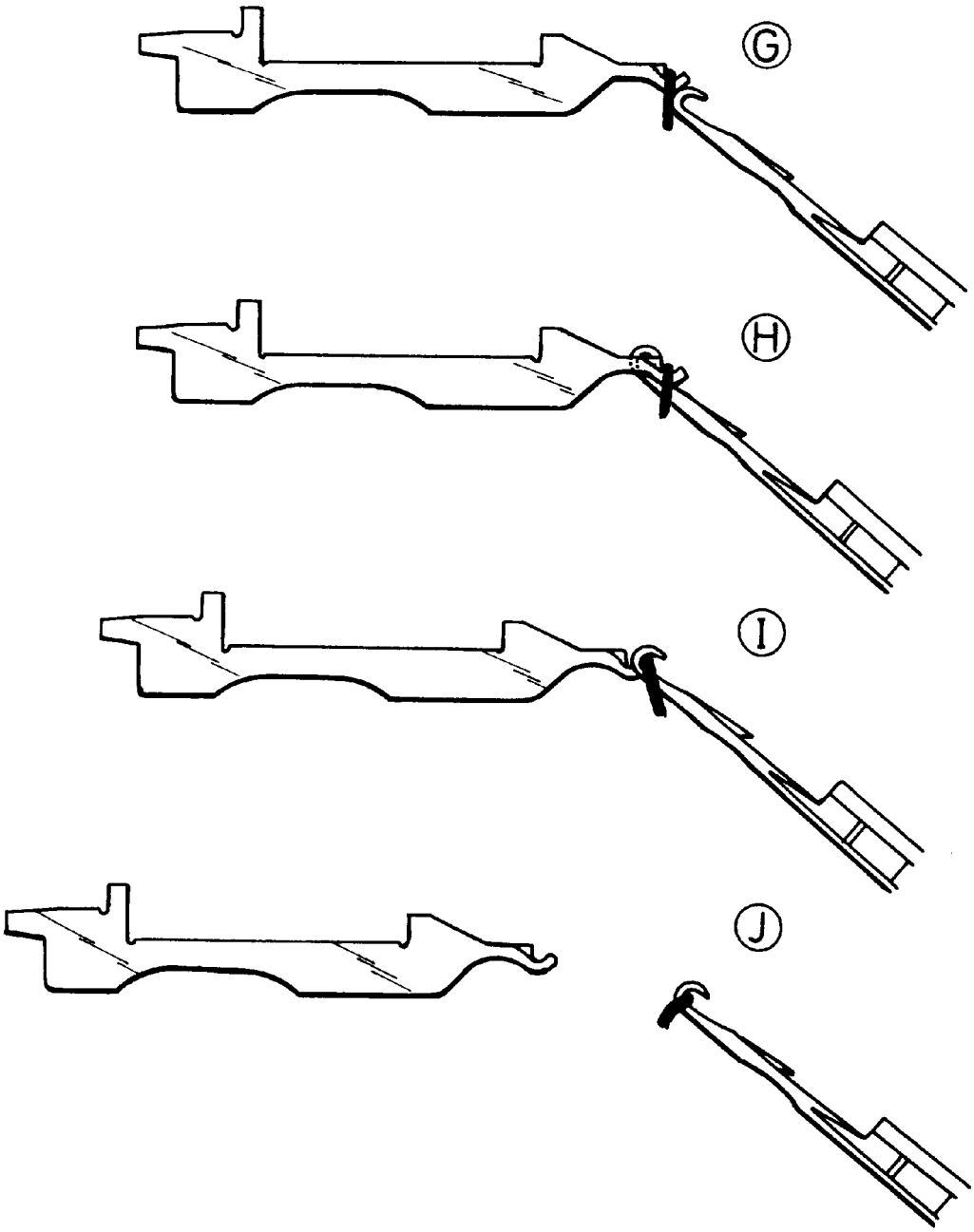
FIG. 12 is a side view of the motional relationship between the knitting needle and the transfer jack in each of the positions G–J of FIG. 11.

Subsequently, the carriages 2A, 2B are moved in an adverse direction at a predetermined position along the needle beds 4A, 4B. The predetermined position is the position at which the convex cam portion 109 of the swinging cam 119 has come out of the corresponding group of transfer jacks 6 to be disengaged from the engaging projection 75 of the transfer jacks 6. FIG. 11 is a view corresponding to FIG. 9, illustrating traveling paths of the butts taken when the carriage 2 moves rightwards. FIG. 12 is a side view of the motional relationship between the knitting needle 3A and the transfer jack 6 in each of the positions G–J of FIG. 11. Reference numerals 127', 124' and 125' in the figures show the traveling paths of the butts.

When the front knitting needle 3A to receive the loop 128 therein is moved from position G to position H, the butt 41*b* is pushed up by the transferring receiving cam 57 and the hook 31 is advanced into the loop engaging portion 73 of the transfer jack 6 and is put into the state of passing through the loop 128 (FIG. 12-G, 12-H).

At position I, the knitting needle 3A is lowered by the transferring raising cam 55. Simultaneously, the butt 81 of the transfer jack 6 retracted to the pushed-out position M via the lowering cam surface of the upper guide cam 93 starts to retract to the retracted position L by the action of the cam 105. As a result, the loop 128 retained by the loop engaging portion 73 is transferred to the hook 31 of the knitting needle 3A (FIG. 12-I).

Subsequently, at position J, the butt 81 of the transfer jack 6 is retracted to the original retracted position L, while also the knitting needle 3A receiving the loop 128 therein is also retracted further, to complete the transferring of the loop FIG. 12-J).

Modifications may of course be made of the invention to produce the substantially same results. For example, in addition to or instead of the rear needle bed which in illustration is so structured as to be racked transversely, the front needle bed may be so structured as to be racked or only the transfer jack bed may be so structured as to be racked. Also, instead of the transfer jack beds which in illustration are arranged over the front and rear needle beds, respectively, only one transfer jack bed may be arranged over either of the front and rear needle beds.

As seen from the above, a flat knitting machine having a transferring mechanism using transfer jacks according to the invention is so constructed that the transfer jacks can be prevented from being swung and shifted vertically in the jack grooves, at the time of the selecting or non-selecting of the transfer jacks, unlike the prior art. This can eliminate the need of the swinging mechanism for the selection, and thus the transferring mechanism can be simplified in structure to that amount. In addition, the transfer jacks are not brought into cam engagement by the operating cam, unless the transfer jacks are used. In other words, the transfer jacks are not subjected to the cam control, in the case of the transfer jacks being not used, as in the case of a knitting fabric being knitted. This can eliminate the disadvantage in the prior art that every time the carriage passes the transfer jacks, the transfer jacks are brought into the cam engagement and can produce the advantage that the engaging portions of the transfer jacks can be prevented from being worn by abrasion and the like.

What is claimed is:

1. A flat knitting machine having a transferring mechanism using transfer jacks, the flat knitting machine comprising:

a pair of front and rear needle beds facing each other to form an inverted V-shaped form with a needle bed gap defined between adjoining end portions of the needle beds;

knitting needles received in needle grooves formed in rows on the needle beds;

front and rear carriages reciprocally movable on the needle beds and having a knitting needle operating cam for controlling the knitting needles to move forward and backward;

a transfer jack bed supported by a supporting member and arranged over at least any one of the needle beds;

transfer jacks received in reciprocally movable relation in jack grooves formed in rows on the transfer jack bed;

a transfer jack operating cam provided at a front end portion of the carriage in proximity to the needle bed gap between the needle beds; and a transferring mechanism for enabling the transfer jack bed and the needle beds to move relative to each other in a lateral direction, to transfer a loop between the transfer jack and the knitting needle, wherein the transfer jacks each have (i) at a front end thereof a loop engaging portion; (ii) at a rear end thereof a selected engaging projection extending rearwardly from a rear end of the jack groove when the transfer jack is in its retracted position; and (iii) at an upper edge of a jack body thereof an advance-and-retreat controlling butt which extends from an upper surface of the jack groove and is engageable with the transfer jack operating cam to control the transfer jack to move forward and backward; and wherein the carriages each include (i) a cam which is driven by an actuator so that said cam can be selectively engaged with the selected engaging projection of the transfer jack to guide the transfer jack in its retracted position from the engaged position to its pushed-out position and which is arranged in association with the selected engaging projection of the transfer jack; (ii) a raising cam which is engageable with the butt projecting from the upper surface of the transfer jack as guided to the pushed-out position, to push up the transfer jack to its transferring position; and (iii) a lowering cam which can act on the butt of the transfer jack as advanced to its transferring position, to drive the transfer jack to retract to its retracted position.

2. A flat knitting machine having a transferring mechanism using transfer jacks according to claim 1, wherein the transfer jacks are composed of at least two kinds of transfer jacks, with the selected engaging projections shifted in phase from each other with respect to the heightwise direction, and a selecting portion is provided at a position corresponding to the transfer jack engaging projection.

3. A flat knitting machine having a transferring mechanism using transfer jacks according to claim 2, wherein the transfer jacks are bunched together in groups of two or more under the same height of selected engaging projections, and those transfer jacks groups different in height of the selected engaging projections are arranged alternately.

4. A flat knitting machine having a transferring mechanism using transfer jacks according to claim 1, wherein the cam for guiding the transfer jack to its pushed-out position is formed by a swinging cam which is swingable between two positions of (i) an operative position at which the selective engaging projection is pushed out by a swinging lever and a swinging actuator capable to switch the swinging lever and (ii) a standby position at which the selected engaging projection is not acted upon by the swinging lever and the swinging actuator.

5. A flat knitting machine having a transferring mechanism using transfer jacks according to claim 4, wherein the swinging cam has a cam surface having a substantial widthwise dimension smaller than the widthwise dimension of each of the transfer jack groups.

* * * * *